US007127980B2

(12) United States Patent
Enya et al.

(10) Patent No.: US 7,127,980 B2
(45) Date of Patent: Oct. 31, 2006

(54) VANE, VALVE TIMING CONTROL DEVICE, AND SLIDING MEMBER

(75) Inventors: Yasuhiro Enya, Kariya (JP); Shigeru Anada, Toyota (JP); Masaki Kobayashi, Toyota (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 55 days.

(21) Appl. No.: 10/849,210

(22) Filed: May 20, 2004

(65) Prior Publication Data

US 2004/0244747 A1 Dec. 9, 2004

(30) Foreign Application Priority Data

May 21, 2003 (JP) ..... 2003-143122

(51) Int. Cl.
*F01C 9/00* (2006.01)

(52) U.S. Cl. ..... 92/121

(58) Field of Classification Search ..... 92/121
See application file for complete search history.

(56) References Cited

U.S. PATENT DOCUMENTS 4,618,317 A 10/1986 Matsuzaki
4,985,092 A 1/1991 Kaede et al.
6,413,061 B1 * 7/2002 Esumi et al. ..... 418/63
2002/0170425 A1 * 11/2002 Tarutani et al. ..... 92/70
2003/0019449 A1 1/2003 Hiratsuka et al.
2003/0221646 A1 * 12/2003 Nakajima et al. ..... 123/90.17

FOREIGN PATENT DOCUMENTS

| | | |
|---|---|---|
| EP | 0 356 615 A1 | 4/1989 |
| JP | 62-93353 | 10/1985 |
| JP | 64-18985 | 7/1987 |
| JP | 5-78729 | 9/1991 |
| JP | 09-195004 | 5/1996 |
| JP | 10-251728 | 3/1997 |
| JP | 11-22677 | 6/1997 |
| JP | 11-101189 | 9/1997 |
| JP | 11-117883 | 10/1997 |
| JP | 2001-221182 | 2/2002 |
| JP | 2003-301220 | 2/2003 |

OTHER PUBLICATIONS

Hnadbook of Chemistry and Physics, 56th ed, Ohio, CRC Press1976, ppF-152-F153.*
"Tufftride QP, QPQ", U1 Engineering Co., Ltd., http://www.uiengineering.com/Html/EN/Tuffride.html.

* cited by examiner

*Primary Examiner*—F. Daniel Lopez
(74) *Attorney, Agent, or Firm*—Reed Smith LLP; Stanley P. Fisher, Esq.; Juan Carlos A. Marquez, Esq.

(57) ABSTRACT

A vane, a valve timing control device at least including a vane, or a sliding member include at least one of chromium and manganese with 10–20 weight %, and carbon with 0.70 weight % or less wherein the vane is formed by nitriding treatment.

6 Claims, 4 Drawing Sheets

VANE, VALVE TIMING CONTROL DEVICE, AND SLIDING MEMBER

CROSS REFERENCE TO RELATED APPLICATIONS

This application is based on and claims priority under 35 U.S.C. §119 with respect to a Japanese Patent Application 2003-143122, filed on May 21, 2003, the entire content of which is incorporated herein by reference.

FIELD OF THE INVENTION

This invention generally relates to a vane, a valve timing control device, and a sliding member. The sliding material is applicable to sliding parts such as oil pump, compressor, hydraulic actuator, and valve timing control device.

BACKGROUND OF THE INVENTION

Hydraulic device such as an oil pump and a hydraulic actuator will be explained as an example of background of the present invention. For these hydraulic devices, a tool steel (e.g. SKH51, etc.) has been frequently used as a vane material. The main purpose of the vane is as follows. Namely, in the case of an oil pump, function of a pump is achieved by pushing out of oil filed in a cavity formed between a housing and the vane using the vane via drive-shaft. On the other hand, in the case of a vane type hydraulic actuator, required function is achieved by driving a drive-shaft fixed to a vane which is actuated by taking oil in and out in a cavity formed between a housing and the vane.

Mechanical properties required to the vane are strength to bear with required oil pressure, especially bending strength and fatigue strength, and abrasion resistance against sliding between the vane and the housing or the other members surrounding the vane.

In recent internal combustion engine, hard carbon soot tends to increase in lubricating oil since fuel supply system has been alternated to direct injection type and so on. Abrasion resistance against hard carbon soot floating in the oil has been required for the vane with the exception of abrasion resistance against surrounding members with relative motion.

In addition, abrasion resistance has been required for the other hard particles such as fine silica (generally 0.2 mm or less) which is floating in oil by entering in unavoidable condition of device using and production.

Another example is disclosed in Japanese Patent Publication published as Toku-Kou-Hei 1 (1989)-18985. This rotational fluid compressor includes a vane and an opposed member. The vane is made of a steel system material which includes 0.50–1.30 weight % of carbon, 11.0–20.0 weight % of chromium and iron with hardening, tempering and nitro-carburizing treatment. And the opposed member made of a cast iron, which includes 0.10–6.00% of carbide and have a graphite shape of A, B, D, and E in ASTM standard with HRC 40–55 in hardness.

Another example is disclosed in Japanese Patent Laid-Open Publication No. H5-78792. This rotational fluid compressor includes a vane and an opposed member. The vane is made of a steel system material which includes 0.50–1.30 weight % of carbon, 11.0–20.0 weight % of chromium and iron with hardening, tempering and ion nitriding treatment. And the opposed member made of a cast iron, which includes 0.10–6.00% of carbide and have a graphite shape of A, B, D, and E in ASTM standard with HRC 40–60 in hardness.

According to the above described vane made of iron system material typified by SKH51, carbon content included in the steel exceeds 0.85 weight %. Then, carbide such as $Fe_3C$ is generated in the vane body matrix. This compound can improve abrasive resistance of the vane.

However, additional improvement of slidability of the vane has been required in these years. For example, frequency of oil change by user is getting decrease since engine parts and so on are changed to have high performance in these years. Under this condition, carbon soot and silica hard particles floating in the oil contribute to generation of erosion and abrasion in high speed flow. Accordingly, only soft portion of the vane body matrix has a tendency to abrade away, thus carbide which is hard particles (such as $Fe_3C$) has a tendency to be exposed at the surface of the vane. Therefore, the vane has a tendency to attack the surface of the opposed member such as a housing and a rotor.

SUMMARY OF THE INVENTION

In light of foregoing, according to an aspect of the present invention, a vane made of a metal material includes at least one of chromium and manganese with 10–20 weight %, and carbon with 0.70 weight % or less wherein the vane is formed by nitriding treatment.

It is preferable that a hard compound layer including at least one of $Cr_{(1-x)}N_x$ and $Mn_{(1-x)}N_x$ is formed by the nitriding treatment.

It is still further preferable that the carbon content of the metal material is less than 0.50 weight %.

It is an another aspect of the present invention, a valve timing control device includes a first rotational member integrally rotating with one of a crankshaft and a camshaft of an engine, a second rotational member rotatably attached to the first rotational member to form a hydraulic chamber between the first rotational member and the second rotational member and integrally rotating with the other of the crankshaft and the camshaft of the engine, a vane provided on at least one of the first rotational member and the second rotational member for dividing the hydraulic chamber into a first chamber and a second chamber, and an oil path supplying and discharging oil to and from at least one of the first chamber and the second chamber for changing relative rotational phase between the first rotational member and the second rotational member in peripheral direction wherein the vane includes at least one of chromium and manganese with 10–20 weight %, and carbon with 0.70 weight % or less wherein the vane is formed by nitriding treatment.

It is an another aspect of the present invention, a sliding member includes at least one of chromium and manganese with 10–20 weight %, and carbon with 0.70 weight % or less wherein the vane is formed by nitriding treatment.

BRIEF DESCRIPTION OF THE DRAWING FIGURES

The foregoing and additional features and characteristics of the present invention will become more apparent from the following detailed description considered with reference to the accompanying drawing figures wherein.

DETAILED DESCRIPTION OF THE INVENTION

A preferred embodiment of the present invention will be described hereinbelow in detail with reference to the accompanying drawings.

(Material Selection of the Embodiment)

Figure 1:
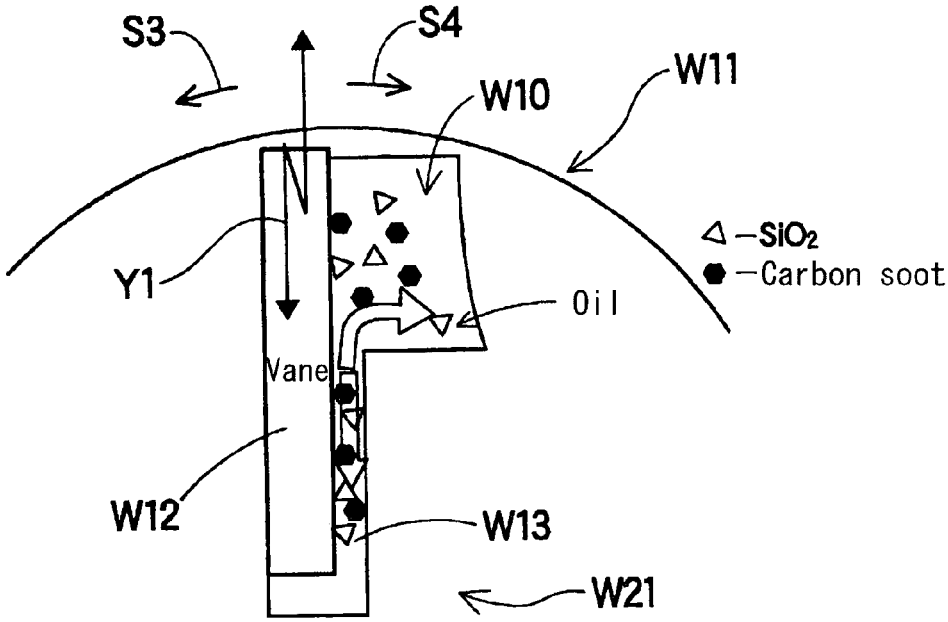
FIG. 1 is a schematic view illustrating using condition of a vane in an environment including foreign material.
Figure 2:
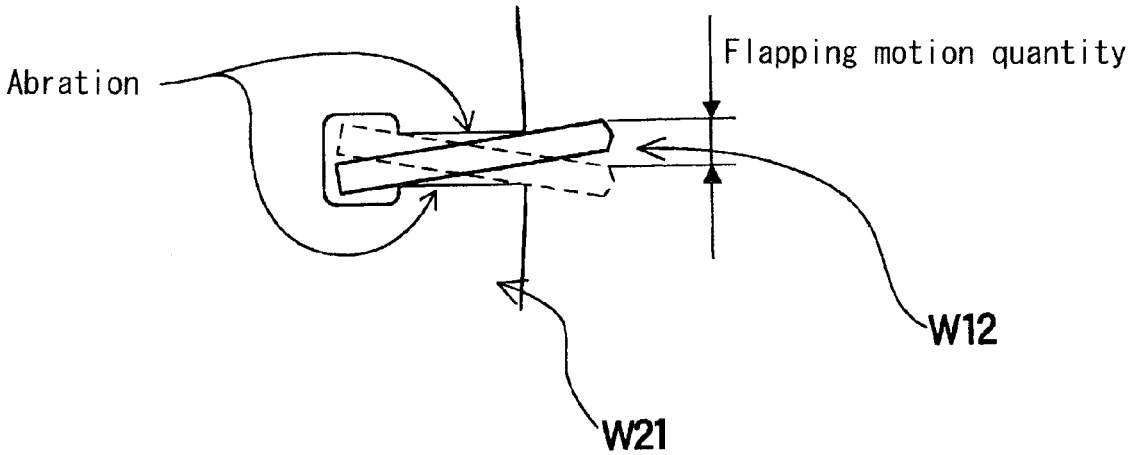
FIG. 2 is a schematic view illustrating definition of flip-frap motion quantity of a vane.

FIG. 1 is a schematic of a typical usage of a sliding member. The sliding member slides with contacting to an opposed member and receives a load generated by hydraulic pressure. The sliding member may be used in a situation with hard foreign material such as carbon soot and silica attacks to the sliding member, or cavitation caused by involving of air into oil acts to the sliding member.

The typical usage shown in FIG. 1 includes a part W11 (such as housing portion) forming hydraulic chamber W10, a part W21 (such as driving member), a vane W12 supported by the part W21 and used as sliding member. The vane W12 moves in arrow S3, S4 direction with pressing against to the part W11 such as housing using a spring (not shown). The vane W12 slides relative to the part W21 since the vane W12 moves in arrow Y1 direction. In this situation, oil may pass through an interstice W13 between the vane W12 and the part W21, a hard particles included in oil also may pass through the interstice W13. Consequently, surface of the vane W12 has a tendency to selectively abrade away.

Accordingly, it is preferable to set sufficiently higher hardness of the surface of the vane W12 relative to hard particles suspended in oil. Furthermore, it is preferable to exclude carbide type hard particles such as $Fe_3C$ and chromium carbide at the surface of the vane W12 or to minimize the amount of carbide type hard particles such as $Fe_3C$ and chromium carbide at the surface of the vane W12 to prevent attacking to the part W12 such as driving member. When excessive amount of the hard particles such as $Fe_3C$ and chromium carbide exists, it promotes abrasion of the part W12 side. Finally, flapping motion quantity of the vane W12 is increased, and then smooth sliding of the vane W12 tends to be spoiled. For improvement of hardness of common steel member, hard particles such as $Fe_3C$ will be increased since carbon content will be increased. Thus it becomes disadvantage to prevent abrasion.

In the embodiment of the present invention, chromium nitride and manganese nitride are produced by nitriding treatment of a metal material including at least one of chromium and manganese with 10–20 weight % and carbon with 0.70 weight % or less. Thus, nitride compound is produced in the vicinity of surface of the metal material, which includes chromium or manganese as a main element and composes sliding member with restraining generation of hard particles. It allows the surface property highly hard with restraining attacking to an opposed member.

To get abrasion resistance, martensitic material can be adopted as matrix of the metal material composing sliding member typified by vane. Austenitic material can be used as well as martensitic material. If a vane or an opposed material of sliding member is made with high thermal expansion coefficient such as aluminum and aluminum alloy, austenitic material has an advantage to compensate thermal expansion of the material. Therefore, flapping motion of the vane and the sliding member and oil leak, which are caused by difference of thermal expansion, may be reduced.

According to the embodiment, carbon content of the metal material is defined to 0.70 weight % or less. It is defined to reduce hard carbide particles such as $Fe_3C$ in the matrix. If the carbon content is excessive, produced amount of hard carbide particles such as $Fe_3C$ may be increased, and it has a tendency to attack the opposed member as mentioned above. Therefore, carbon content may be set to 0.65 weight % or less and 0.60 weight % or less. To reduce production of hard carbide particles such as $Fe_3C$ in matrix, the carbon content may be set to 0.55 weight % or less, 0.53 weight % or less, and 0.50 weight % or less. In addition, the carbon content may be set to 0.49 weight % or less, 0.48 weight % or less, 0.45 weight % or less, and 0.40 weight % or less according to need. With considering above mentioned circumstance, the minimum carbon content may be set to 0.01 weight % or more or 0.02 weight % or more. If the carbon content is insufficient, it makes difficult to procure the metal material, it makes difficult to obtain effect of hardness improving by nitriding, and it promotes changing to ferrite so that it makes difficult to obtain high strength.

Chromium content in the metal material is 10 weight %–20 weight %. If the chromium content is insufficient, amount of chromium nitride produced at the surface has a tendency to be insufficient. If the chromium content is excessive, it promotes changing to ferrite and makes difficult to obtain sufficient strength in quality of sliding member such as vane. Therefore, chrome content may be set to 10–20 weight %, optimally 13–17 weight %.

With considering above mentioned circumstance, upper limit of chromium content may be set to 16.5 weight %, 16.0 weight %, 15.0 weight %, and 14.0 weight %. The lower limit of chromium content corresponding with each upper limit may be set to 11.0 weight %, 12.0 weight %, 13.5 weight %, and 14.0 weight %. If manganese content is low (i.e. 0.60 weight % or less or 0.50 weight % or less) in the steel member, generally the chromium content may be set to 10–20 weight %, 10–19.4 weight % or 10–19 weight %.

Manganese content in the metal material is 10 weight %–20 weight %. If the manganese content is insufficient, amount of manganese nitride produced at the surface has a tendency to be insufficient. If the manganese content is excessive, it promotes excessively changing of the matrix to austenite, which makes it difficult to obtain sufficient strength of the sliding member such as vane. Further more, when the matrix is excessively changed to austenite, linear thermal expansion coefficient is increased. Depending on nature of opposed member, a clearance between the sliding member such as vane and part supporting the sliding member changes with temperature change, and it has a tendency to deteriorate smooth operation. Therefore, manganese content may be set to 10–20 weight %, optimally 11–18 weight % or 13–17 weight %.

With considering above mentioned circumstance, upper limit of manganese content may be set to 16.5 weight %, 16.0 weight %, and 15.0 weight %. The lower limit of manganese content corresponding with each upper limit may be set to 13.0 weight %, 13.5 weight %, and 14.0 weight %. If chromium content is low (i.e. 0.60 weight % or less or 0.50 weight % or less), generally the manganese content may be set to 12–17 weight %.

Molybdenum may be added in the metal material. The purpose of molybdenum addition is to improve softening resistance at tempering treatment. Amount of molybdenum may be set to 6 weight % or less, and lower limit of molybdenum content may be 0.1 weight % or more (or 0.14 weight % or more).

If molybdenum amount is excessive, double carbide of chromium and molybdenum and molybdenum carbide are produced in large quantity, which causes deposition of hard particles in the sliding member such as vane in excessive quantities. Therefore, with considering this point of view, molybdenum content may be set to 6 weight % or less or 4 weight % or less, optimally 2 weight % or less, 1.5 weight % or less, or 1 weight % or less.

Although condition of nitriding treatment may be suitably selected depending on composition of the sliding material or property and cost required, it may be set to nitriding treatment temperature 410–590° C., and nitriding treatment time 30 minutes–40 hours. If nitriding treatment temperature is high, nitriding treatment time is abbreviated. If nitriding treatment temperature is low, nitriding treatment time gets long. If the iron system material is hardened before nitriding treatment, it is preferable to nitriding treatment with paying attention since excessive reverse of hardening may occur in high temperature nitriding treatment. If nitriding treatment temperature is set to relatively low temperature (commonly, 410° C.–450° C.), excessive reverse of hardening may be reduced, distortion may be reduced, generation of porous layer formed by nitriding treatment may be reduced or prevented. As a nitriding treatment, TUFFTRIDE® treatment (i.e., a salt-bath nitrocarburizing treatment, test condition A—test condition D in Table 2) using cyanate solution bath and gas nitriding treatment (test condition E in Table 2) adding reducing gas may be used. Hard compound layer including at least one of chromium nitride and manganese nitride may be formed in the vicinity of the surface by nitriding treatment. In other words, hard compound layer including at least one of $Cr_{(1-x)}N_x$ and $Mn_{(1-x)}N_x$ may be formed at the vicinity of the surface by nitriding treatment.

(Example of Evaluation of the Embodiment)

The embodiment of the present invention will be explained based on an example of examination. Table 1 is chemical composition of test samples (No. 1–No. 10) which are carbon steel corresponding to vane material. Test samples were formed as vane shape. In test samples, No. 1–No. 4 are low carbon type and martensitic stainless steel (class: SUS632). These are martensitic and aging treatment was done with nitriding treatment at the same time. No. 5–No. 9 are martensitic stainless steel (class: ASL508) of medium carbon—high carbon type, and was hardened before nitriding treatment.

No. 10 is a high manganese steel (austenitic). Composition of the high manganese steel was 0.6–0.7 weight % of carbon, 0.2–0.50 weight % of silicon, 14–16 weight % of manganese, 1.0–1.5 weight % of nickel, 0.30 weight % or less of chromium, 0.30 weight % or less of cupper, and 0.06 weight % or less of phosphorous. Carbon content of above mentioned test samples No. 1–No. 10 is 0.70 weight % or less.

TABLE 1

| Chemical component | C | Si | Mn | P | Ni | Cr | Cu | Ti | Mo | N |
|---|---|---|---|---|---|---|---|---|---|---|
| No. 1–No. 4 | 0.042 | 1.53 | 0.30 | 0.025 | 7.21 | 14.70 | 0.70 | 0.39 | — | 0.009 |
| No. 5–No. 9 | 0.65 | 0.4 | 0.3 | — | — | 13.0 | — | — | 0.3 | — |
| No. 10 | 0.6–0.7 | 0.2–0.5 | 14–16 | 0.06 | 1.0–1.5 | 0.30 | 0.30 | — | — | — |

TABLE 2

| Heat treatment condition | Nitriding treatment condition A | B | C | D | E |
|---|---|---|---|---|---|
| Time | 60 min. | 60 min. | 45 min. | 45 min. | 17 hr. |
| Temperature (° C.) | 580 | 480 | 580 | 480 | 420 |

TABLE 3

| Abrasion resistance test condition | | | | |
|---|---|---|---|---|
| Operation rate | Oil temperature | Carbon content in oil | Foreign material content in oil | Number of repetition |
| 100 Hz | 130° C. ± 5° C. | 0.6% | 50 mg/L | 500,000 times |

TABLE 4

| Test result | | | | | |
|---|---|---|---|---|---|
| Test sample No. | Classification | Nitriding condition | Abrasion of drive part (mm) | Abrasion of vane (mm) | Flapping motion (mm) |
| 1 | SUS632 | A | 0.002 | 0.014 | 0.140 |
| 2 | SUS632 | B | 0.003 | 0.008 | 0.080 |
| 3 | SUS632 | C | 0.002 | 0.011 | 0.130 |
| 4 | SUS632 | D | 0.001 | 0.010 | 0.110 |
| 5 | ASL508 | A | 0.024 | 0.005 | 0.270 |
| 6 | ASL508 | B | 0.016 | 0.003 | 0.180 |
| 7 | ASL508 | C | 0.024 | 0.005 | 0.270 |
| 8 | ASL508 | D | 0.018 | 0.005 | 0.22 |
| 9 | ASL508 | E | 0.001 | 0.005 | 0.075 |
| 10 | High Mn steel | A | 0.009 | 0.009 | 0.230 |
| Reference1 | SKH51 | Untreated | 0.210 | 0.002 | 1.400 |
| Reference2 | SUS632 | Untreated | 0.004 | 0.202 | 2.100 |

For each test specimen No. 1–No. 10 mentioned above, nitrocarburizing treatment was carried out with predetermined nitriding treatment condition (A–E) as shown in Table 2. For test condition A, nitriding treatment temperature was 580° C., and time was 60 minutes. For test condition B, nitriding treatment temperature was 480° C., and time was 60 minutes. For test condition C, nitriding treatment temperature was 580° C., and time was 45 minutes. For test condition D, nitriding treatment temperature was 480° C., and time was 45 minutes. For test condition E, since nitriding treatment temperature was relatively low (i.e. 420° C.), time was set to relatively long period (i.e. 17 hours).

Hard compound layer including at least one of $Cr_{(1-x)}N_x$ and $Mn_{(1-x)}N_x$ was formed in the vicinity of the surface of each test specimen by nitriding treatment. For test samples No. 1–No. 9 which have relatively high content of chromium, hard compound layer mainly including chromium nitride $Cr_{(1-x)}N_x$ in the vicinity of the surface. Thickness of the compound layer was approximately 8–25 i m.

For the test sample No. 10 which has relatively high content of manganese, hard compound layer mainly including manganese nitride $Mn_{(1-x)}N_x$ was formed in the vicinity of the surface. Thickness of the compound layer was approximately 8–25 i m. Since sample No. 10 is high manganese steel (austenitic) and low carbon content, generation of hard particles such as $Fe_3C$ was reduced.

Figure 3:
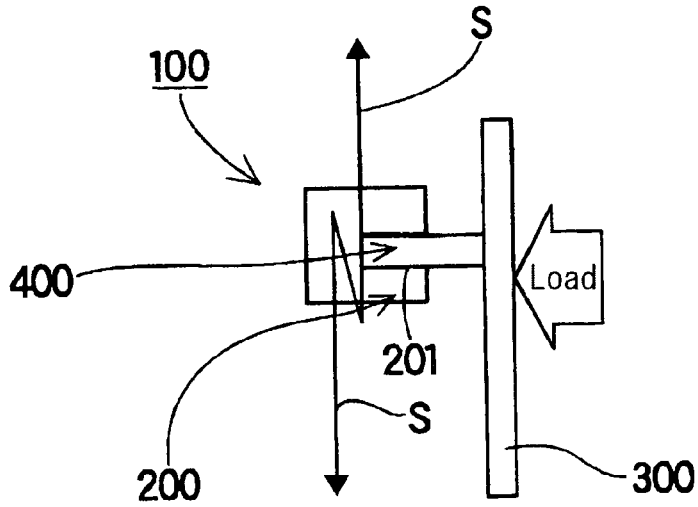
FIG. 3 is a schematic view of a model test apparatus.

Each test sample mentioned above was set to a model test apparatus 100 of hydraulic actuator as shown in FIG. 3. The model test apparatus includes test sample holder 200 (which corresponds to drive part) holding vane shaped test sample 400 at a ditch 201, and a plate 300 which is pressed by one end of the test sample 400 by loading.

Figure 4:
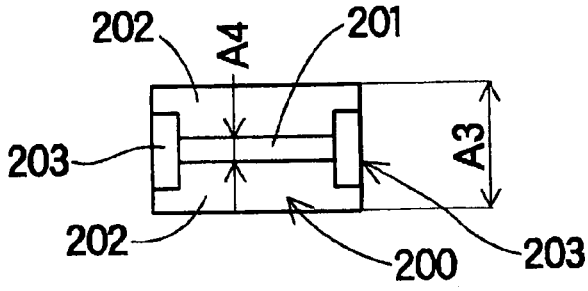
FIG. 4(A) is a plane view schematically illustrating a test specimen holder.
FIG. 4(B) is a side view schematically illustrating a test specimen holder.
Figure 4:
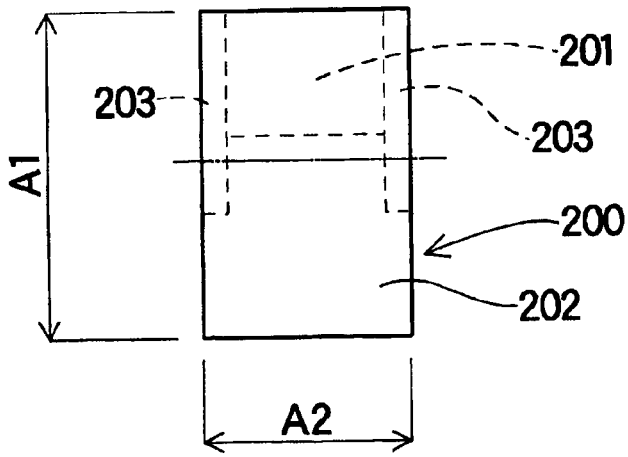

FIG. 4(A) and FIG. 4(B) show the test sample holder 200. The test sample holder 200 includes a pair of opposed plates 202, 202 and a pair of stopper plates 203, 203 so as to form the ditch 201 which was detachably engaged with the vane shaped test sample 400. The vane shaped test sample 400 was slidably engaged with the ditch 201. Dimension of the test sample holder 100 was 52 mm of A1, 28 mm of A2, 12 mm of A3, and 2 mm of A4. Dimension of the vane shaped test sample 400 was 2 mm of thickness, 21 mm of width, and 16 mm of height.

The test sample holder 200 was made of iron family (which is not cast iron) sintered alloy (JIS-PMF4040, iron-cupper-carbon family sintered alloy) and carburized hardened material. The material was hardened after heating at 850° C. for 30 minutes and then tempered. Temperature of the oil for hardening was 50° C. Tempering condition was 180° C. for 60 min.

The test sample 400 was inserted to the test sample holder 200, and abrasion resistance test was conducted. Specifically, test was conducted by means of repeatedly sliding the test sample holder 200 to the arrow S direction in FIG. 3 with a predetermined operating condition shown in Table 3. Pushing load was defined to 13 kgf (by assuming 1 kgf as 9.8N, it is 127.4N). In this condition, interstice was formed between the test sample 400 and the inner wall of the ditch 201. Therefore, the test sample slides and grinds with the inner wall of the ditch 201 as the result of repeating flapping motion of the teat sample 400 in the interstice.

On the other hand, oil (wherein the condition is shown in Table 3) was supplied while sliding operation of the test sample and the ditch 201. The supplied oil was filled into the interstice between the test sample 400 and the ditch 201 of the test sample holder 200 with passing along wall of the test sample 400. Surface of the test sample 400 and the ditch 201 was grinded with a condition wherein carbon and the other foreign matter were included in the oil filled in the interstice between the test sample 400 and the ditch 201 of the test sample holder 200. This condition can be actually assumed that a vane and surface of a rotational member were ground each other.

Above mentioned abrasion resistance test was conducted for each specimen No. 1–No. 10 after nitriding. The abrasion resistance test was also conducted for a reference material 1 (class: JIS SKH51, expressed as reference 1 in Table 4) and a reference material 2 (class: JIS SUS632, expressed as reference 2 in Table 4).

Evaluation result is shown in Table 4. For the reference material 1 (JIS SKH51), abrasion of the test sample holder 200 (corresponds to drive part) was considerable and was 0.210 mm, in spite of that abrasion of its own (abrasion of vane) was relatively small and was 0.002 mm. Accordingly, flapping motion of the test sample was considerable and was 1.400 mm. In this condition, hard particles such as $Fe_3C$ may be produced in the reference material 1, and it may make the material increasing a tendency to attack opposed member since carbon content was relatively high and was 0.80–0.90 weight %. Therefore, the test sample holder 200, which is the opposed member of the test sample 400, may be considerably worn.

For the reference material 2 (JIS SUS632), abrasion of its own (abrasion of vane) was considerable and was 0.202 mm, in spite of that abrasion of the test sample holder 200 (corresponds to drive part) was relatively small and was 0.004 mm. Accordingly, flapping motion of the test sample was the most considerable and was 2.100 mm.

On the other hand, according to the test samples of the embodiment of the present invention, abrasion of both its own (vane) and the test sample holder 200 was few compared with the reference material 1 and the reference material 2. This abrasion resistance property was obtained by restraining of hard particles (such as Fe3C) production.

Therefore, test samples No. 1–No. 10 restrained abrasion at the surface of the vane 16 according to reference materials. Particularly, even if operating condition of the vane 16 was placed with fine hard particles such as carbon soot and silica, abrasion resistance at the surface of the vane 16 was improved. Vane material having good abrasion resistance (i.e. foreign matter resistance and erosion resistance) has been needed. Thus, longer operating life may become possible for an oil pump and a hydraulic actuator.

(Application Example)

Figure 5:
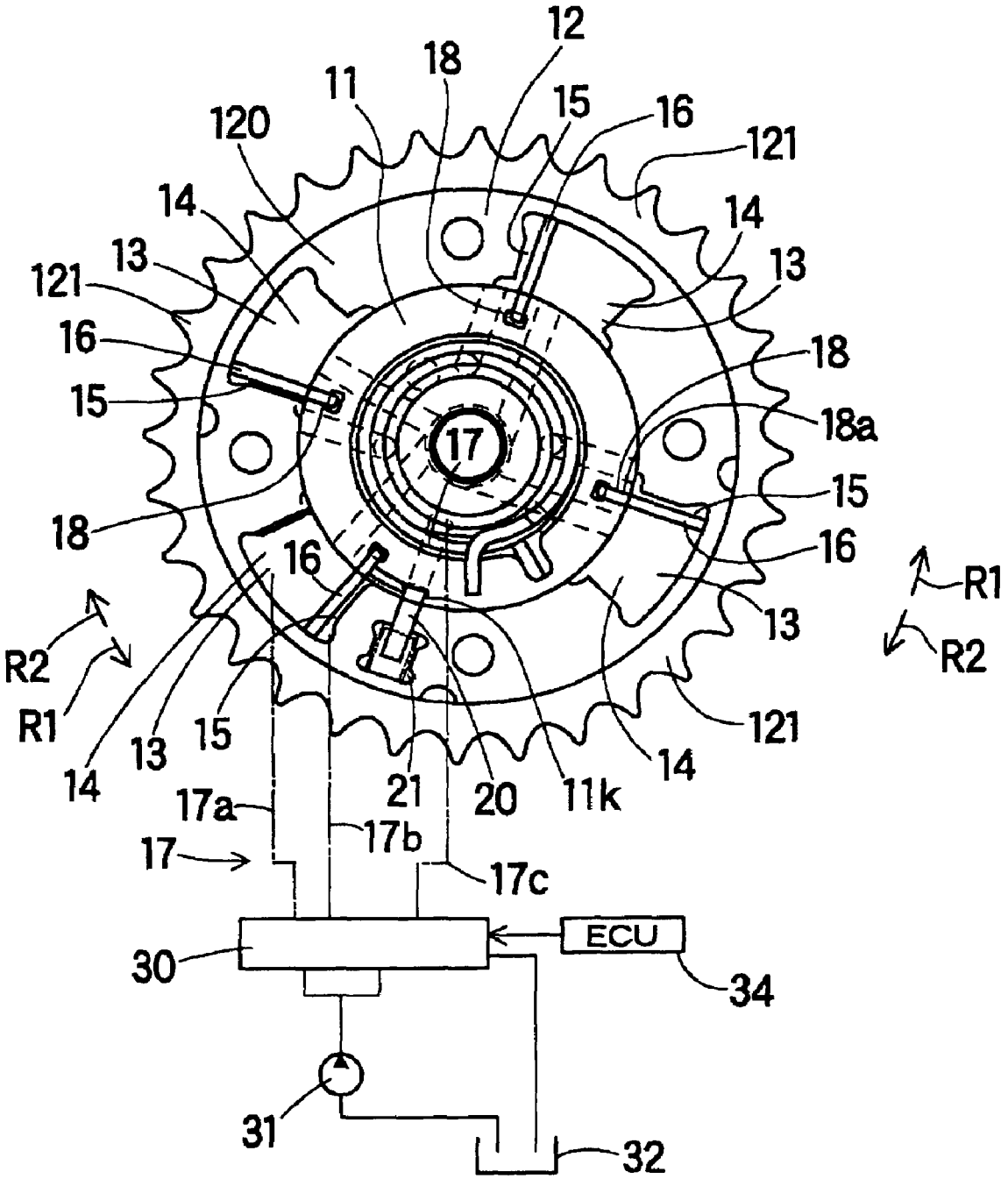
FIG. 5 is a cross sectional view schematically illustrating relevant part of a valve timing control device according to an embodiment of the present invention.
Figure 6:
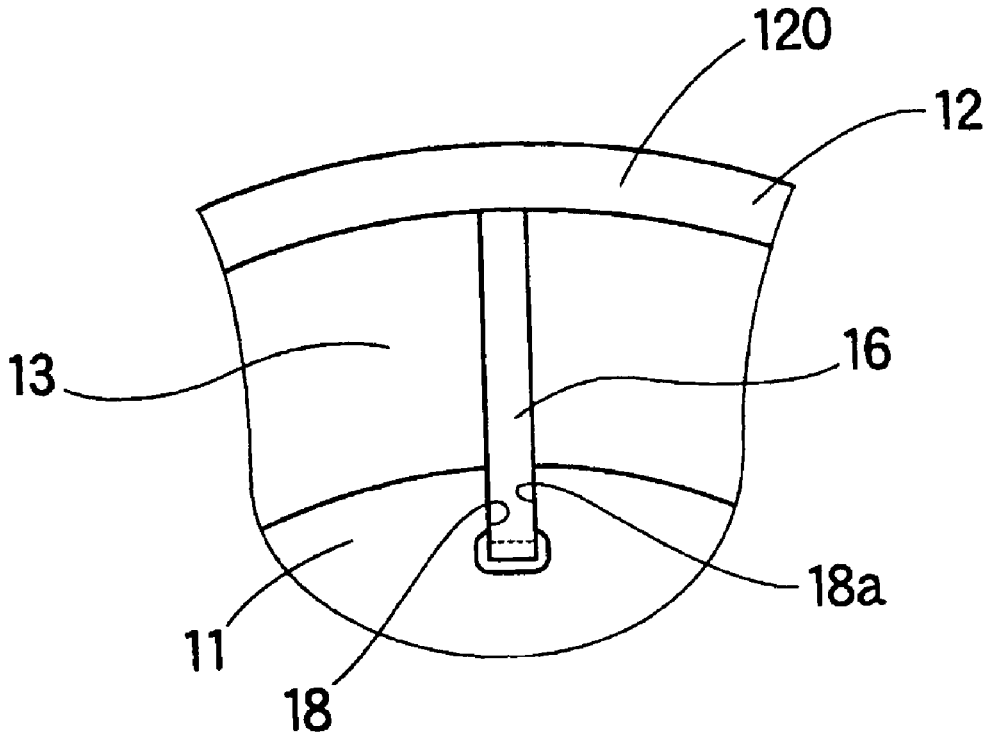
FIG. 6 is a partial cross sectional view schematically illustrating vicinity of a vane of a valve timing control device according to an embodiment of the present invention.

FIG. 5 and FIG. 6 shows an application example applied to a valve timing control device. The valve timing control device is a device equipped to an engine of a vehicle. The valve timing control device includes a first rotational member 11 integrally rotating with one of a crankshaft and a camshaft of an engine, a second rotational member 12 integrally rotating with the other of the crankshaft and the camshaft of the engine, a vane 16 provided at least one of the first rotational member 11 and the second rotational member 12 for dividing the hydraulic chamber 13 into a first chamber 14 and a second chamber 15 as a sliding part, and an oil path 17 providing and discharging oil to at least one of the first chamber 14 and the second chamber 15 for changing relative phase of rotation between peripheral direction of the first rotational member 11 and the second rotational member 12, as shown in FIG. 5. The first rotational member 11 may be made of aluminum alloy material or iron material as examples, or may be also made with sintered material and cast material.

First chambers 14 are connected with one another. Second chambers 15 are also connected with one another. Plural vane ditch 18 are disposed at periphery of the first rotational member 11 which is shaped as a rotor. Plural vane 16 is slidably inserted to each vane ditch 18 as shown in FIG. 5 and FIG. 6. Vanes 16 are biased into radial outward direction by vane spring (not shown) at all time. Thus, vanes 16 divide the first chamber 14 and the second chamber 15.

AS shown in FIG. 5, the oil path 17 includes an oil path 17*a* connected to first chambers 14 and an oil path 17*b* connected to second chambers 15. The oil path 17 is connected to a control valve 30, and moreover connected to an oil pump 31 as an oil supplier and a reservoir 32 as an oil discharge side. The control valve 30 is controlled by a control unit (ECU) 34.

The rotor-shaped first rotational member 11 is rigidly attached to the camshaft mounted to a cylinder block of the engine so as to integrally rotate with the camshaft. The second rotational member 12 includes a housing 120 coaxially engaging with the first rotational member 11 and a sprocket 121 integrated with the housing 120. A transmission member such as timing chain and timing belt is constructed between the sprocket 121 and a gear of the crankshaft of the engine.

In this point, when the crankshaft of the engine rotates, the second rotational member 12 rotates with the sprocket 121, the rotor shaped first rotational member 11 rotates through oil filled in the hydraulic chamber 13, and then camshaft rotates. A cam of the camshaft makes a valve of the engine pushes up to make it opening and closing operation of the valve. Phase of the vane 16 indicates relative rotational phase in peripheral direction of the first rotational member 11 and the second rotational member 12.

A lock member 20 attached to the second rotational member 12 is biased to radial inward direction (lock direction) at all time by a lock spring 21 as a biasing means. When an end portion of the lock member 20 biased by the lock spring 21 is engaged with a lock ditch 11*k* of the rotor shaped first rotational member 11, relative rotational phase in peripheral direction of the first rotational member 11 and the second rotational member 12 is fixed by lock function of the lock member 20, then, the first rotational member 11 and the second rotational member 12 rotate as a unit. In this embodiment, opening-closing timing of the valve timing of the engine is set to obtain smooth start up behavior at the locking position of the lock member 20.

On the other hand, if relative rotational phase in peripheral direction of the first rotational member 011 and the second rotational member 12 is changed, opening-closing timing of the engine valve can be adjustable in response to operating condition of the engine. To carry out this function, releasing of lock member 20 is carried out by supplying hydraulic pressure through an oil path 17*c* into the lock releasing oil path 17 and by displacing the lock member 20 into radial outward direction (lock releasing direction). When locking condition of the lock member 20 is released in this manner, relative rotational phase in peripheral direction of the first rotational member 11 and the second rotational member 12 can be changed. When oil supplying to the second chamber 15 of the hydraulic chamber 13 or oil discharging from the first chamber 14 of the hydraulic chamber 13 are carried out in lock releasing condition of the lock member 20 as described above, position of the vane 16 can be displaced into relatively the other direction in peripheral direction (arrow R2 direction).

When oil is supplied to the first chamber 14 of the hydraulic chamber 13 through the oil pass 17 or oil is discharged from the second chamber of the hydraulic chamber 13 through the oil pass 17, position of the vane 16 can be displaced into relatively one direction in peripheral direction (arrow R1 direction). Therefore, relative rotational phase in peripheral direction of the first rotational member 11 and the second rotational member 12 can be adjusted in response to operating condition of the engine, then, opening-closing timing of the engine valve can be adjusted. The arrow R1 direction corresponds to one of an advance angle direction and a delay angle direction. The arrow R2 direction corresponds to the other of the advance angle direction and the delay angle direction. The advance angle direction means the direction advancing valve timing. The delay angle direction means the direction delaying valve timing.

According to the present embodiment, lock releasing of the lock member 20 is carried out by supplying hydraulic pressure into the lock releasing oil path 17 and by displacing the lock member 20 into radial outward direction (lock releasing direction). Not only lock releasing method is the method described above, the other method may be applicable. For example, lock releasing of the lock member 20 may be carried out by using centrifugal force concurrent with revolution speed without using lock releasing oil pass 17. Namely, the lock member 20 is displaced into radial outward direction (lock releasing direction) by means of centrifugal force which acts to the lock member 20 and intends to radial outward direction.

By the way, in the present embodiment, the vane 16 as a sliding member is formed by nitriding treatment of a metal material including 10–20 weight % of an element at least one of chromium and manganese and less than 0.70 weight % of carbon. Specifically, the vane 16 is formed by producing the hard compound layer including at least one of chromium nitride $Cr_{(1-x)}N_x$ and manganese nitride $Mn_{(1-x)}N_x$ by nitriding treatment of a metal material including 10–20 weight % of an element at least one of chromium and manganese and less than 0.70 weight % of carbon. Namely, the vane 16 is formed using nitrided material including one of the test sample No. 1–No. 10 mentioned above as examples. Therefore, even if operating condition of the vane 16 is placed with fine hard particles such as carbon soot and silica, abrasion resistance at the surface of the vane 16 may be improved. Vane material having good abrasion resistance (i.e. foreign matter resistance and erosion resistance) may be obtained.

Furthermore, it allows restraining aggression to a ditch inner wall 18*a* of the vane ditch 18 of the rotor shaped first rotational member 11 which is the opposed member of the vane 16. Therefore, longer operating life may become possible for the vane 16 and the rotor shaped first rotational member 11 which is the opposed member of the vane 16 if the valve timing control device is used for extended period.

The principles, a preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A vane made of a metal material comprising:

manganese with 14–16 weight %;

silicon with 0.2–0.5 weight %;

carbon with 0.6–0.7 weight %;

nickel with 1.0–1.5 weight %;

chromium with 0.3 weight % or less;

copper with 0.3 weight % or less; and phosphorous with 0.06 weight % or less;

manganese with 10–20 weight %; and carbon with 0.70% weight % or less, wherein the vane has a hard compound outer layer including $Mn_{(1-x)}N_x$ and formed by a nitriding treatment, wherein the nitriding treatment is carried out by a gas nitriding treatment adding reducing gas, and wherein a range of nitriging treatment temperature is from 410° C. to 590° C. and a range of nitriding treatment time is from 30 minutes to 40 hours.

2. A vane according to claim 1, wherein an opposed material disposed to contact with the vane is made of non-cast iron material.

3. A valve timing control device, comprising:

a first rotational member integrally rotating with one of a crankshaft and a camshaft of an engine;

a second rotational member rotatably attached to the first rotational member to form a hydraulic chamber between the first rotational member and the second rotational member and integrally rotating with the other of the crankshaft and the camshaft of the engine;

a vane provided on at least one of the first rotational member and the second rotational member for dividing the hydraulic chamber into a first chamber and a second chamber; and an oil path supplying and discharging oil to and from at least one of the first chamber and the second chamber for changing relative rotational phase between the first rotational member and the second rotational member in peripheral direction, wherein the vane comprises:

manganese with 14–16 weight %;

silicon with 0.2–0.5 weight %;

carbon with 0.6–0.7 weight %;

nickel with 1.0–1.5 weight %;

chromium with 0.3 weight % or less, cupper with 0.3 weight % or less; and phosphorous with 0.06 weight % or less;

wherein the vane is formed by a nitriding treatment carried out by a gas nitriding treatment adding reducing gas, and wherein a range of nitriging treatment temperature is from 410° C. to 590° C. and a range of nitriding treatment time is from 30 minutes to 40 hours.

4. A valve timing control device according to claim 3, wherein an opposed material disposed to contact with the vane is made of non-cast iron material.

5. A method of manufacturing a vane, comprising:

preparing a vane made of a metal material including at least one of chromium and manganese with 10–20 weight %; and carbon with 0.70% weight % or less; and forming a hard compound outer layer including at least one of $Cr_{(1-x)}N_x$ and $Mn_{(1-x)}N_x$ at the vane by nitriding treatment, wherein the nitriding treatment is carried out by salt bath nitriding process using cyanate solution bath or gas nitriding treatment adding reducing gas, wherein the vane comprises:

manganese with 14–16 weight %;

silicon with 0.2–0.5 weight %;

carbon with 0.6–0.7 weight %;

nickel with 1.0–1.5 weight %;

chromium with 0.3 weight % or less;

cupper with 0.3 weight % or less; and phosphorous with 0.06 weight % or less.

6. The method of manufacturing a vane according to claim 5, wherein the nitriding treatment is carried out by gas nitriding treatment adding reducing gas, and a range of nitriging treatment temperature is from 410° C. to 590° C. and a range of nitriding treatment time is from 30 minutes to 40 hours.

* * * * *